US008833932B2

(12) United States Patent
Okumura

(10) Patent No.: US 8,833,932 B2
(45) Date of Patent: Sep. 16, 2014

(54) RECORDING APPARATUS

(75) Inventor: Masayuki Okumura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 46 days.

(21) Appl. No.: 13/429,433

(22) Filed: Mar. 25, 2012

(65) Prior Publication Data

US 2012/0249709 A1 Oct. 4, 2012

(30) Foreign Application Priority Data

Mar. 31, 2011 (JP) ..... 2011-079594

(51) Int. Cl.
*B41J 29/13* (2006.01)
*B41J 29/38* (2006.01)

(52) U.S. Cl.
CPC . *B41J 29/13* (2013.01); *B41J 29/38* (2013.01)
USPC ..... 347/108

(58) Field of Classification Search
CPC ..... B41J 29/13
USPC ..... 347/108
See application file for complete search history.

(56) References Cited

U.S. PATENT DOCUMENTS

2006/0152546 A1 7/2006 Udagawa
2007/0007473 A1 1/2007 Kumagai
2007/0132819 A1* 6/2007 Umeda et al. ..... 347/86
2009/0237427 A1 9/2009 Kumagai
2009/0237477 A1 9/2009 Kumagai
2010/0245446 A1* 9/2010 Nishikori et al. ..... 347/15

FOREIGN PATENT DOCUMENTS

JP 2003-112446 A 4/2003
JP 2006-231719 A 9/2006
JP 2007-015138 A 1/2007

OTHER PUBLICATIONS

Japan Patent Office, Notification Reasons for Refusal for Japanese Patent Application No. 2011-079594, mailed Jul. 23, 2013.

* cited by examiner

*Primary Examiner* — Alessandro Amari
*Assistant Examiner* — Alexander C Witkowski
(74) *Attorney, Agent, or Firm* — Baker Botts L.L.P.

(57) ABSTRACT

A recording apparatus, including: a support portion; a recording portion; a first casing; a second casing; a positioning mechanism: a restricting mechanism configured to be selectively placed in one of: a restricted state in which a pivotal movement of the second housing is restricted; and a non-restricted state in which the pivotal movement of the second housing is not restricted, and an interlocking mechanism configured to move one of a guide pin and a guide hole in conjunction with the restricting mechanism, such that the guide pin and the guide hole are selectively placed at one of: an engaged state in which the guide pin and the guide hole engage each other when the restricting mechanism is in the restricted state; and a non-engaged state in which the guide pin and the guide hole do not engage when the restricting mechanism is in the non-restricted state.

20 Claims, 10 Drawing Sheets

RECORDING APPARATUS

CROSS REFERENCE TO RELATED APPLICATION

The present application claims priority from Japanese Patent Application No. 2011-079594, which was filed on Mar. 31, 2011, the disclosure of which is herein incorporated by reference in its entirety.

BACKGROUND OF THE INVENTION

1. Field of the Invention

The present invention relates to a recording apparatus configured to record an image on a recording medium.

2. Description of Related Art

There is known a recording apparatus having a positioning mechanism including a guide pin (e.g. positioning pin) that extends along a prescribed direction and a guide hole (e.g. guide portion) with which the guide pin is to be engaged. In the recording apparatus, a relative position of a recording portion (e.g. recording unit) and a support portion (e.g. conveyer device) for supporting a recording medium is fixed by engagement of the guide pin and the guide hole.

SUMMARY OF THE INVENTION

If the above-described recording apparatus is configured such that the recording portion pivots relative to the support portion about a prescribed shaft for ensuring, between the recording portion and the support portion, a space in which a user performs a maintenance operation, the following problems may arise. That is, where the recording portion is pivoted relative to the support portion in a state in which the guide pin and the guide hole are held in engagement with each other, the guide pin interferes with the wall which defines the guide hole.

It is therefore an object of the invention to provide a recording apparatus which ensures positioning accuracy by engagement of a guide hole and a guide pin while restraining interference between the guide pin and a wall that defines the guide hole.

To attain the object indicated above, the present invention provides a recording apparatus, comprising:

a support portion configured to support a recording medium;

a recording portion configured to record an image on the recording medium supported by the support portion;

a first casing configured to hold the support portion;

a second casing connected to the first casing through a shaft and pivotable relative to the first casing about the shaft, the second casing being configured to be selectively positioned by a pivotal movement thereof at one of: a close position at which the second casing is positioned close to the first casing; and a separate position at which the second casing is positioned more distant from the first casing than when the second casing is positioned at the close position, the second casing being configured to hold the recording portion such that the support portion and the recording portion are opposed to each other when the second casing is positioned at the close position;

a positioning mechanism including a guide pin that extends in a prescribed direction and a guide hole which move relative to each other in association with the pivotal movement of the second casing, the positioning mechanism being configured to define a relative position of the recording portion and the support portion by engagement of the guide pin and the guide hole when the second casing is positioned at the close position; and a restricting mechanism configured such that, when the second casing is positioned at the close position, the restricting mechanism can be selectively placed in one of: a restricted state in which the pivotal movement of the second housing is restricted; and a non-restricted state in which the pivotal movement of the second housing is not restricted, and an interlocking mechanism configured to move one of the guide pin and the guide hole in the prescribed direction in conjunction with the restricting mechanism, such that the guide pin and the guide hole are selectively placed in one of: an engaged state in which the guide pin and the guide hole engage each other, when the restricting mechanism is in the restricted state; and a non-engaged state in which the guide pin and the guide hole do not engage each other, when the restricting mechanism is in the non-restricted state.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

There will be explained one embodiment of the present invention with reference to the drawings.

Figure 1:
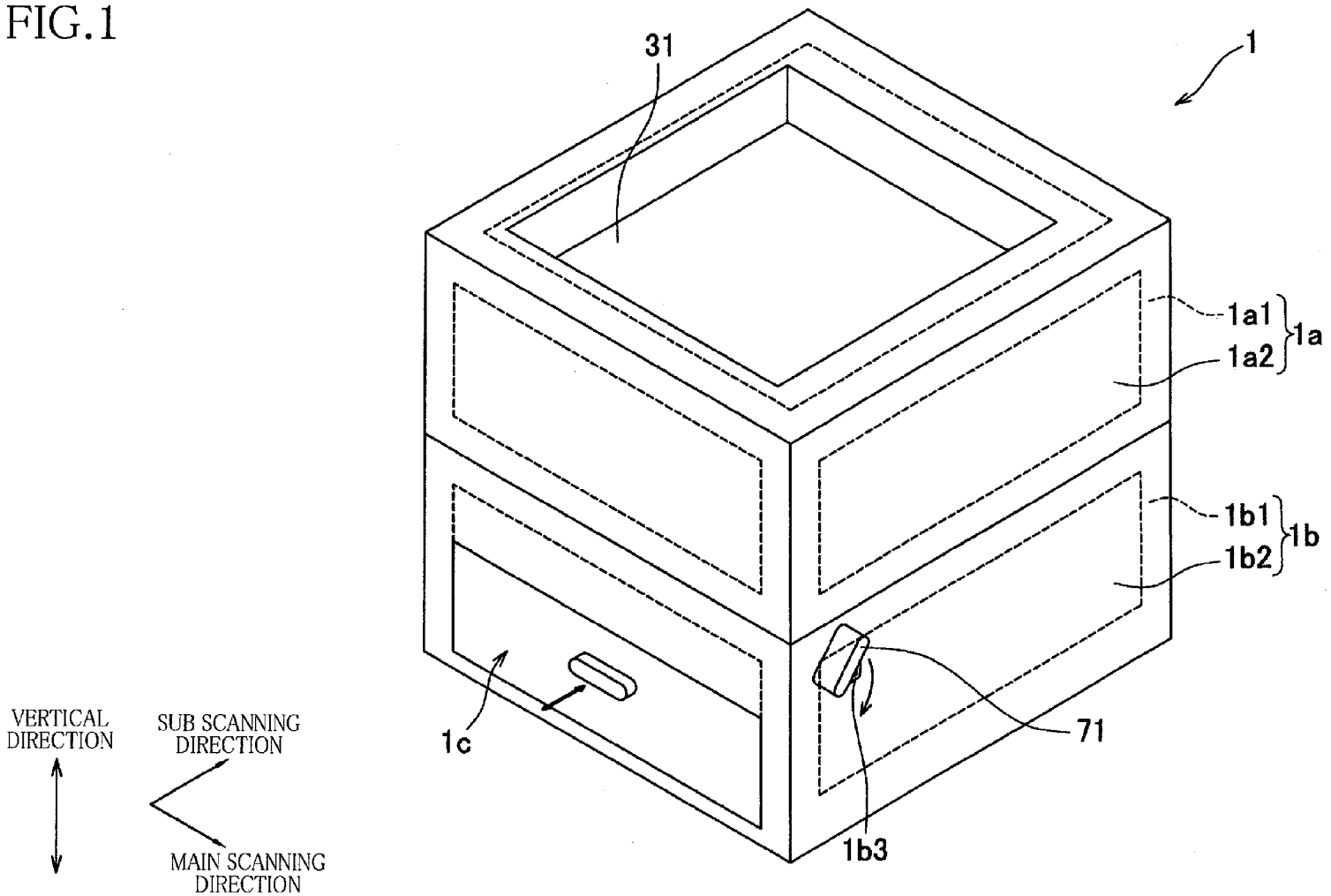
FIG. 1 is a perspective view showing an appearance of an ink-jet printer according to one embodiment of the invention.
Figure 2:
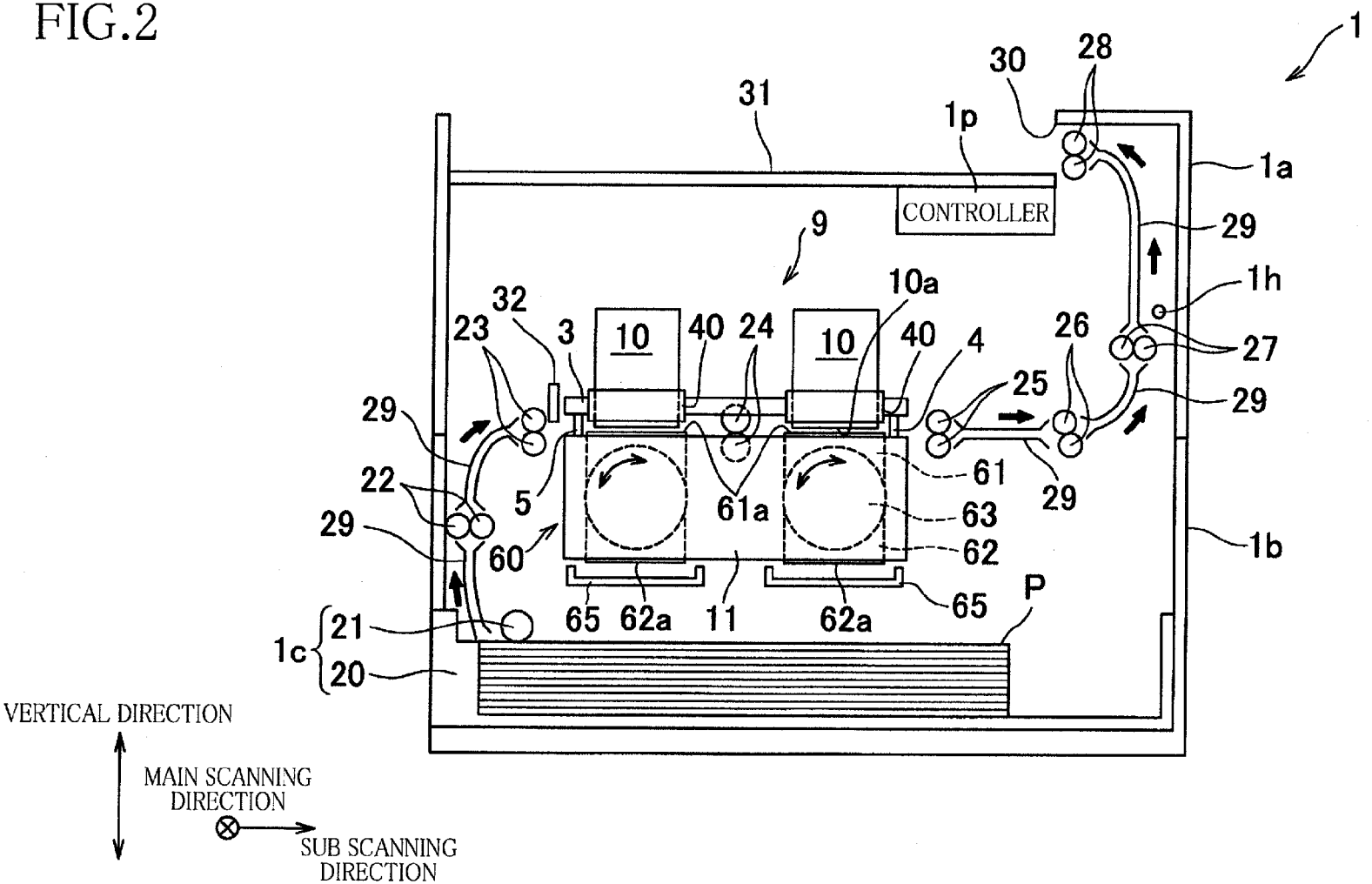
FIG. 2 is a schematic side view showing an inside of the printer.
Figure 3:
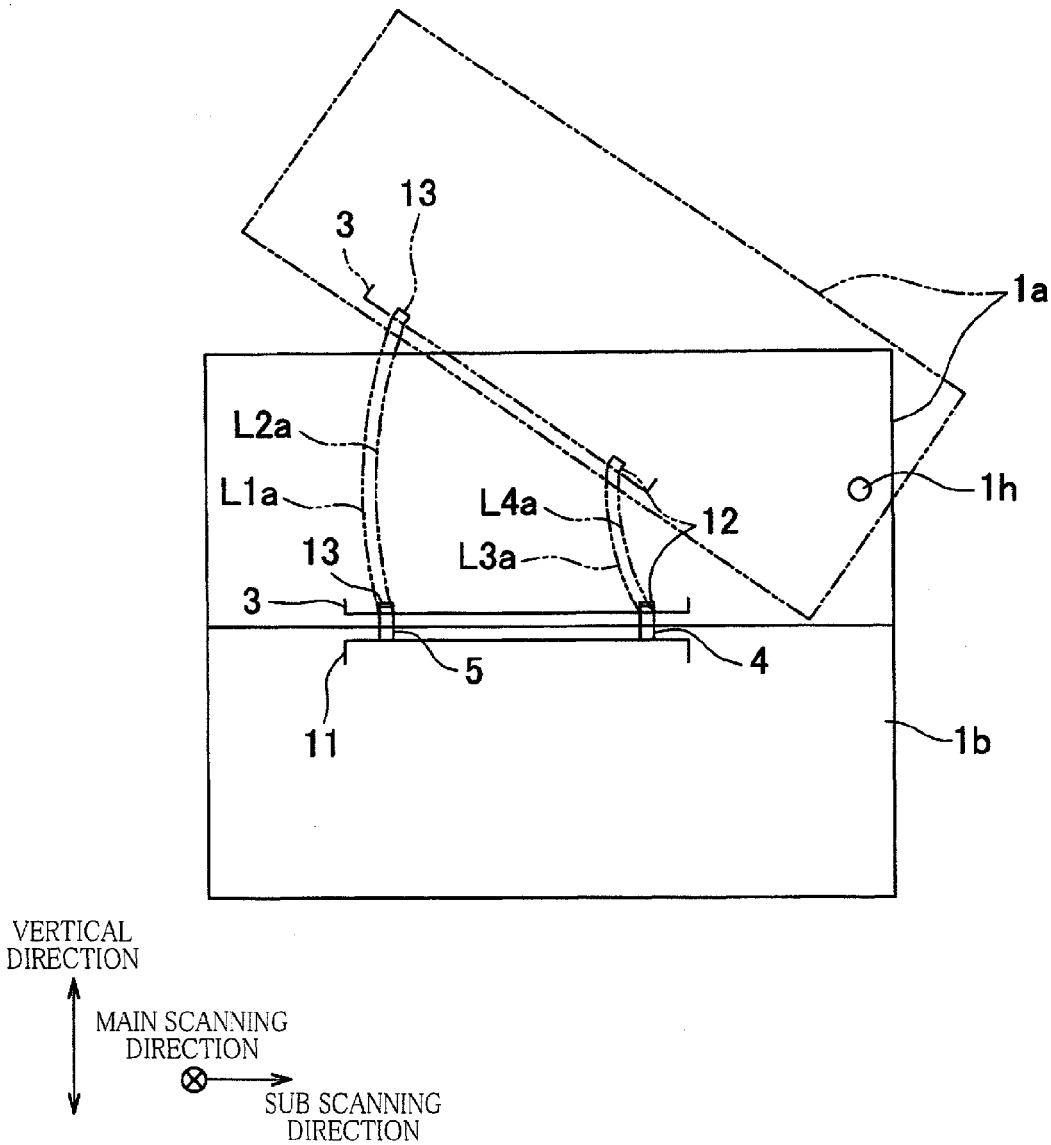
FIG. 3 is an explanatory view showing a state in which an upper casing shown in FIG. 2 is pivoted.

Referring first to FIGS. 1-3, there will be explained an overall structure of an ink-jet printer 1 as one embodiment of a recording apparatus of the invention.

The printer 1 includes an upper casing 1*a* as a second casing and a lower casing 1*b* as a first casing both of which have a rectangular parallelepiped shape and are substantially identical in size. The lower surface of the upper casing 1*a* is open while the upper surface of the lower casing 1*b* is open. The upper casing 1*a* includes a frame 1*a*1 as a framework and a cosmetic cover 1*a*2 covering the frame 1*a*1. Similarly, the lower casing 1*b* includes a frame 1*b*1 as a framework and a cosmetic cover 1*b*2 covering the frame 1*b*1. The upper casing 1*a* is superimposed on the lower casing 1*b* so that the opening surfaces of the respective upper and lower casings 1*a*, 1*b* are closed, whereby a space is defined in the printer 1, as shown in FIG. 2. On a top plate of the upper casing 1*a*, a discharge portion 31 is provided. In the space defined by the upper and lower casings 1*a*, 1*b*, a sheet conveyance path is formed through which a sheet P as a recording medium is conveyed from a sheet supply unit 1*c* (which will be explained) to the discharge portion 31 along bold arrows shown in FIG. 2.

As shown in FIGS. 2 and 3, the upper casing 1*a* is connected to the lower casing 1*b* via a shaft 1*h* that extends in a main scanning direction at a substantially vertically middle position of one end portion (right end portion in FIGS. 2 and 3) of the upper casing 1*a* in a sub scanning direction. The upper casing 1*a* is pivotable about the shaft 1*h* relative to the lower casing 1*b*. The upper casing 1*a* pivots such that the upper casing 1*a* is selectively positioned at one of: a close position (i.e., the position shown in FIG. 2 and the position indicated by the solid line in FIG. 3) at which the upper casing 1*a* is positioned close to the lower casing 1*b*, namely, the upper casing 1*a* and the lower casing 1*b* are in a closed state; and a separate position (i.e., the position indicated by the long dashed double-short dashed line in FIG. 3) at which the upper casing 1*a* is positioned more distant from the lower casing 1*b* than when the upper casing 1*a* is positioned at the close position, namely, the upper casing 1*a* and the lower casing 1*b* are in an opened state. When the upper casing 1*a* is positioned at the separate position, a part of the sheet conveyance path defined by the upper casing 1*a* and the lower casing 1*b* when the upper casing 1*a* is positioned at the close position is exposed to an exterior, thereby ensuring a work space for a user above the sheet conveyance path. When the work space is ensured by positioning the upper casing 1*a* at the separate position, the user can remove the sheet P jammed in the sheet conveyance path or can perform a maintenance operation on a recording portion 9 or a support portion 60. The maintenance operation on the recording portion 9 or the support portion 60 includes an operation for removing stains adhering to an ejection surface 10*a* (as a recording surface), a support surface 61*a*, or an opposable face 62*a* (explained later), for instance. The shaft 1*h* is provided with a spring (not shown) which biases the upper casing 1*a* in a direction in which the upper casing 1*a* is opened, namely, in a direction from the close position to the separate position. In the present embodiment, the upper casing 1*a* is openable with respect to the horizontal plane at an inclination angle up to substantially 35°.

On one side surface of the cover 1*b*2 of the lower casing 1*b*, namely, on the front right side in FIG. 1, an opening 1*b*3 is formed and a lever 71 of a locking mechanism 70 as a restricting mechanism is exposed from the opening 1*b*3. The locking mechanism 70 is configured to restrict a pivotal movement of the upper casing 1*a* that is positioned at the close position. The locking mechanism 70 will be explained later.

The upper casing 1*a* accommodates: two heads 10, i.e., a pre-coat head 10 for ejecting a pre-treatment liquid and an ink-jet head 10 for ejecting black ink, which are arranged in this order from the upstream side in a sheet conveyance direction (indicated by the bold arrows in FIG. 2) in which the sheet P is conveyed; a frame 3 supporting the two heads 10 and an upper roller of a feed roller pair 24; a head elevating and lowering mechanism 33 (FIG. 8) as a moving mechanism configured to elevate and lower the frame 3 in the vertical direction; two cartridges (not shown) respectively corresponding to the two heads 10; and a controller 1*p* (FIG. 2) configured to control operations of various portions of the printer 1. In the present embodiment, the two heads 10 and the frame 3 constitute a recording portion 9 configured to record an image on the sheet P. The recording portion 9 is held by the upper casing 1*a* via the head elevating and lowering mechanism 33.

The upper casing 1*a* further accommodates upper rollers of respective feed roller pairs 25, 26, an upper guide portion of a guide 29 disposed between the feed roller pairs 25, 26, feed roller pairs 27, 28, and two guides 29 disposed between the feed roller pairs 26, 28 along the sheet conveyance direction. In other words, when the upper casing 1*a* pivots from the close position to the separate position, these components accommodated in the upper casing 1*a* are moved together with the upper casing 1*a*.

The lower casing 1*b* accommodates or holds the support portion 60, wiper units, two waste-liquid discharge trays 65, and the sheet supply unit 1*c*. The lower casing 1*b* further accommodates a sheet sensor 32, feed roller pairs 22, 23, and two guides 29 disposed between the sheet supply unit 1*c* and the feed roller pair 23 along the sheet conveyance direction.

Figure 8:
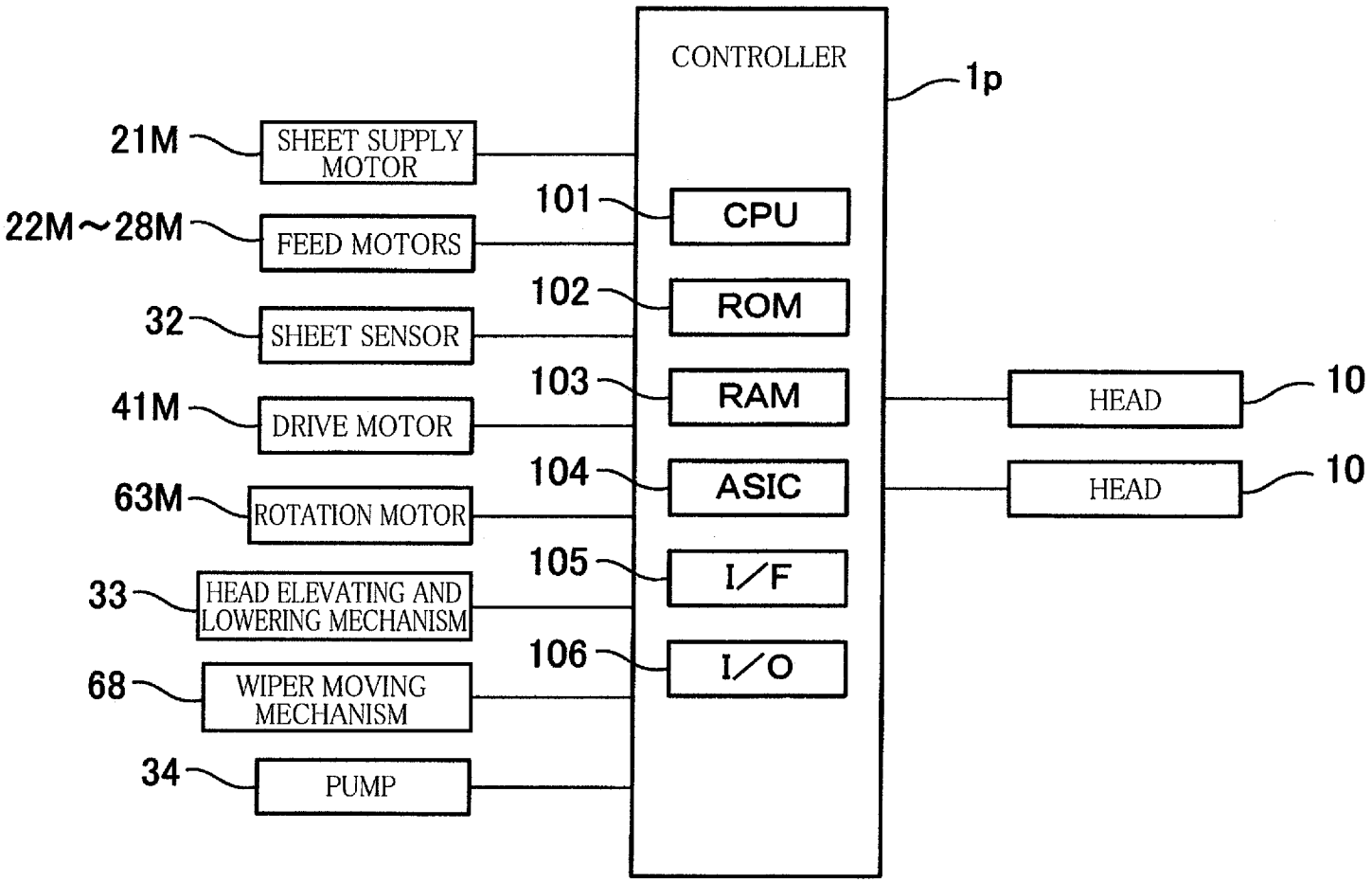
FIG. 8 is a block diagram showing an electric structure of the printer.

The cartridges respectively store the pre-treatment liquid and the black ink (hereinafter collectively referred to as the "liquid" where appropriate) to be supplied to the respective heads 10. The pre-treatment liquid has a function of preventing ink spreading and ink strikethrough, a function of improving a color development property of ink and a quick-drying property of ink, etc. The cartridges are connected to the corresponding heads 10 via respective tubes (not shown) and respective pumps 34 (FIG. 8). Each pump 34 is configured to be driven by the controller 1*p* only when the liquid is forcibly supplied to the corresponding head 10 such as when a purging operation is carried out or when the liquid is initially introduced. Since a negative pressure is generated in liquid passages in each head 10 when an image recording operation is carried out, the liquid in the cartridge is automatically supplied to the corresponding head 10.

Each head 10 is line-type head that has a long dimension in the main scanning direction and has a substantially rectangular parallepiped contour. The two heads 10 are supported by the frame 3 so as to be spaced apart from each other in the sub scanning direction. In each head 10, a joint to which the tube is attached is provided on its upper surface, and a multiplicity of ejection openings are open in its lower surface functioning as the ejection surface 10*a*. In the inside of each head 10, there are formed liquid passages through which the liquid supplied from the cartridge flows to the ejection openings. The frame 3 is provided with enclosure members 40 each of which encloses or surrounds a lower end portion of the periphery of the corresponding head 10. The structure of the enclosure member 40 will be explained in detail.

The head elevating and lowering mechanism 33 is configured to elevate and lower the frame 3 in the vertical direction (as a prescribed direction) so as to move the two heads 10 between a recording position and a retracted position (as a second position), when the upper casing 1*a* is positioned at the close position. At the recording position, the two heads 10 are opposed to the support portion 60, more specifically, the respective support surfaces 61*a* in a first state that will be explained, with a distance suitable for recording interposed therebetween. The recording position includes: a first recording position (as a first position) at which recording is performed on the sheet P with relatively small thickness such as plain paper; and a second recording position (as a third position) at which recording is performed on the sheet P such as thick paper and at which a distance from the support surfaces 61*a* is larger than a distance from the support surfaces 61*a* at the first recording position. The controller 1*p* controls the head elevating and lowering mechanism 33 depending upon the type of the sheet P on which the image is to be recorded, such that the heads 10 are disposed at a corresponding one of the two recording positions (FIG. 10). At the retracted position, the two heads 10 are located away from the support portion 60, more specifically, the respective opposable faces 62*a* in a second state that will be explained, with a larger distance interposed therebetween than the distance between the support portion 60 and the second recording position.

The sheet supply unit 1*c* includes a sheet tray 20 and a sheet supply roller 21. The sheet tray 20 is attachable to and detachable from the lower casing 1*b* in the sub scanning direction. The sheet tray 20 is a box opening upward and is capable of accommodating a plurality of kinds of the sheet P. The sheet supply roller 21 is rotated under the control of the controller 1*p* so as to supply an uppermost one of the sheets P accommodated in the sheet tray 20. The sheet P supplied by the sheet supply roller 21 is fed to the support portion 60 while being guided by the guides 29 and held or nipped by the rollers of the respective feed roller pairs 22, 23.

The support portion 60 is disposed so as to be opposed to the recording portion 9 in the vertical direction. The support portion 60 includes: two rotary members 63 opposed to the respective heads 10; two platens 61 and two opposable members (each as an opposable portion) 62, the platen 61 and the opposable member 62 being fixed to the circumferential surface of the corresponding rotary member 63; and a frame 11 rotatably supporting the two rotary members 63. Each rotary member 63 has a shaft extending in the main scanning direction and is configured to rotate about the shaft under the control of the controller 1*p*. The frame 11 also rotatably supports a lower roller of the feed roller pair 24.

Each platen 61 and each opposable member 62 have a size in the main scanning direction and in the sub scanning direction slightly larger than the ejection surface 10*a*. The platen 61 and the opposable member 62 are disposed on one and the other of opposite sides of the rotary member 63 in the vertical direction.

The surface of the platen 61 functions as the support surface 61*a* for supporting the sheet P while facing the ejection surface 10*a*. The surface of the platen 61 is formed of a suitable material or suitably processed, for enabling the sheet P to be held thereon. For instance, a low-tack silicone layer may be formed on the support surface 61*a*, or a multiplicity of ribs may be formed on the surface of the platen 61 along the sub scanning direction, whereby the sheet P placed on the support surface 61*a* is prevented from floating. The platen 61 is formed of a resin.

The opposable member 62 is formed of a material that inhibits or hardly inhibits transmission of an aqueous component therethrough. The surface of the opposable member 62 is smooth and functions as the opposable face 62*a* to be opposed to the ejection surface 10*a* of the corresponding head 10.

By rotation of the rotary members 63, there are selectively established: the first state (FIG. 2) in which the support surfaces 61*a* are opposed to the corresponding ejection surfaces 10*a* and the opposable faces 62*a* are not opposed to the corresponding ejection surfaces 10*a*; and the second state (FIGS. 7 and 10) in which the support surfaces 61*a* are not opposed to the corresponding ejection surfaces 10*a* and the opposable faces 62*a* are opposed to the corresponding ejection surfaces 10*a*. In the present embodiment, the controller 1*p* controls driving of the rotary members 63 such that the first state is established when the image is recorded on the sheet P by ejection of the liquids from the ejection openings toward the sheet P and such that the second state is established when the purging operation or the wiping operation is carried out and when the heads 10 are in the capping state.

Each waste-liquid discharge tray 65 is disposed below the corresponding rotary member 63, etc., and is held in communication with a waste-liquid tank (not shown). The liquid dropped from the above in the purging operation or the wiping operation is received by and accumulated in the corresponding waste-liquid discharge tray 65 and is discharged to the waste-liquid tank.

Each wiper unit has a wiper 67*a* (FIG. 10) and a wiper moving mechanism 68 (FIG. 8) configured to reciprocatingly move the wiper 67*a* in the main scanning direction. The wiper moving mechanism 68 is controlled by the controller 1*p* to move the wiper 67*a* in the main scanning direction from a standby position which is located on the back side of the corresponding rotary member 63, etc., in FIG. 2. Each wiper 67*a* is formed of an elastic material such as rubber and is a plate-like member extending in the sub scanning direction. Each wiper 67*a* is supported by the corresponding wiper moving mechanism 68 such that its upper end is in contact with the corresponding ejection surface 10*a* and its lower end is in contact with the corresponding opposable face 62*a*, when the wiper 67*a* moves in the main scanning direction at a wiping position (which will be explained) of the head 10, whereby the liquid adhering to the ejection surface 10*a* and the opposable face 62*a* is removed by the wiper 67*a*, namely, cleaning of the ejection surface 10*a* and the opposable face 62*a* is carried out.

Figure 4:
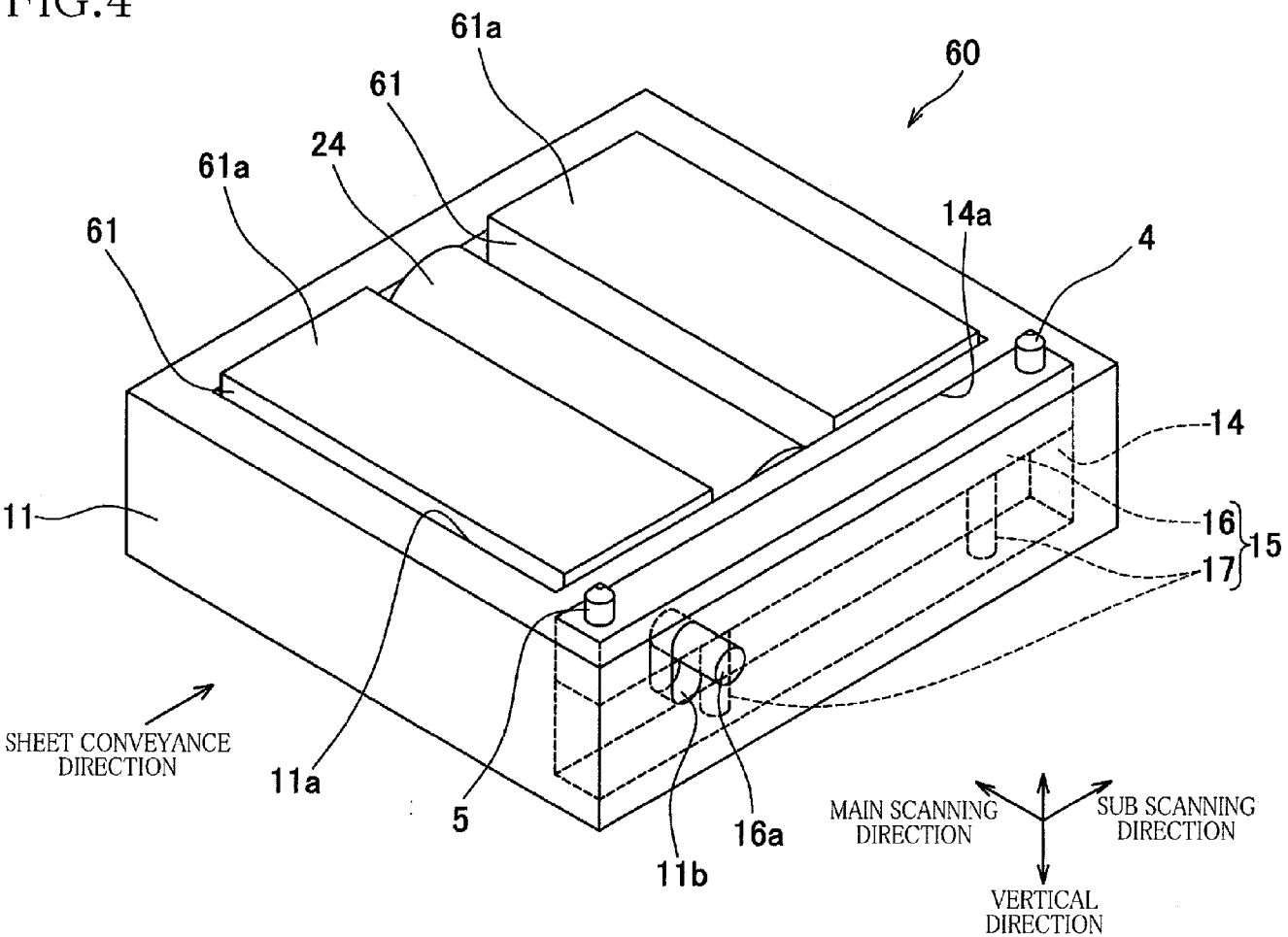
FIG. 4 is a schematic perspective view of a support portion shown in FIG. 2.

Referring next to FIGS. 2 and 4, the frame 11 will be explained.

As shown in FIG. 4, the frame 11 has a short sleeve-like shape and has an inner space 11*a* formed so as to penetrate the frame 11. The frame 11 rotatably supports, in its inner space 11*a*, the two rotary members 63 and a lower roller of a feed roller pair 24. The frame 11 is formed with a recess 14. An opening 14*a* of the recess 14 is formed in the upper surface of the frame 11. In other words, the recess 14 is open in the upper surface of the frame 11. The recess 14 is formed at one end portion of the frame 11 in the main scanning direction (i.e., one end portion of the frame 11 located on the front right side in FIG. 4), so as to extend in the sub scanning direction. In the recess 14, there is disposed an interlocking mechanism 15 operable in an interlocking manner in conjunction with a motion of the locking mechanism 70.

The interlocking mechanism 15 includes: a movable portion 16 configured to move within the recess 14 in the vertical direction; and two springs (each as a biasing portion) 17 biasing the movable portion 16 upward. The two springs 17 are disposed so as to be spaced apart from each other in the sub scanning direction. While, in the present embodiment, the coil springs 17 are employed as the biasing portion, the biasing portion may be constituted by an elastic member other than the coil spring, as long as the elastic member is capable of biasing the movable portion 16 in the direction described above.

The movable portion 16 has a rectangular parallelepiped shape and has substantially the same size, in plan view, as the opening 14*a* of the recess 14. On the upper surface of the movable portion 16, there are formed guide pins 4, 5 that extend upward in the vertical direction (as the prescribed direction, i.e., a direction perpendicular to the ejection surfaces 10*a*). The two guide pins 4, 5 are disposed at one and the other of opposite end portions of the movable portion 16 in the sub scanning direction, in the vicinity of two corner portions of the frame 11. The guide pins 4, 5 are configured to be opposed to respective guide holes 12, 13 (that will be explained later) in the vertical direction. Each of the guide pins 4, 5 is formed of a tapered cylindrical member.

An elongate hole 11*b* communicating with the recess 14 is formed in the side surface of the frame 11 (i.e., the side surface of the frame 11 on the front right side in FIG. 4). The elongate hole 11*b* is formed so as to extend in the vertical direction. A protruding portion 16*a* is formed on the side surface of the movable portion 16. The protruding portion 16*a* is located at a position where the protruding portion 16*a* is fitted in the elongate hole 11*b* and has a length that permits the protruding portion 16*a* to protrude from the elongate hole 11*b* in the main scanning direction. The distal end of the protruding portion 16*a* moves in the vertical direction in association with the motion of the locking mechanism 70, and the movable portion 16 also moves in the vertical direction, whereby the guide pins 4, 5 move in the vertical direction. More specifically, when the protruding portion 16*a* is located at a position at which the protruding portion 16*a* is in contact with the upper end of the elongate hole 11*b*, the movable portion 16 is located at an engaged position at which the guide pins 4, 5 engage with the respective guide holes 12, 13. On the other hand, when the protruding portion 16*a* is located between: a position intermediate between the upper end and the lower end of the elongate hole 11*b* (i.e., at a position shown in FIG. 6B); and a position at which the protruding portion 16*a* contacts the lower end of the elongate hole 11*b*, the movable portion 16 is located at a non-engaged position at which the guide pins 4, 5 do not engage with the respective guide holes 12, 13. That is, the movable portion 16 is selectively positioned at one of the engaged position at which the guide pins 4, 5 engage with the respective guide holes 12, 13; and the non-engaged position at which the guide pins 4, 5 do not engage with the respective guide holes 12, 13.

Referring next to FIGS. 2, 3, and 6, the frame 3 will be explained.

Figure 6A:
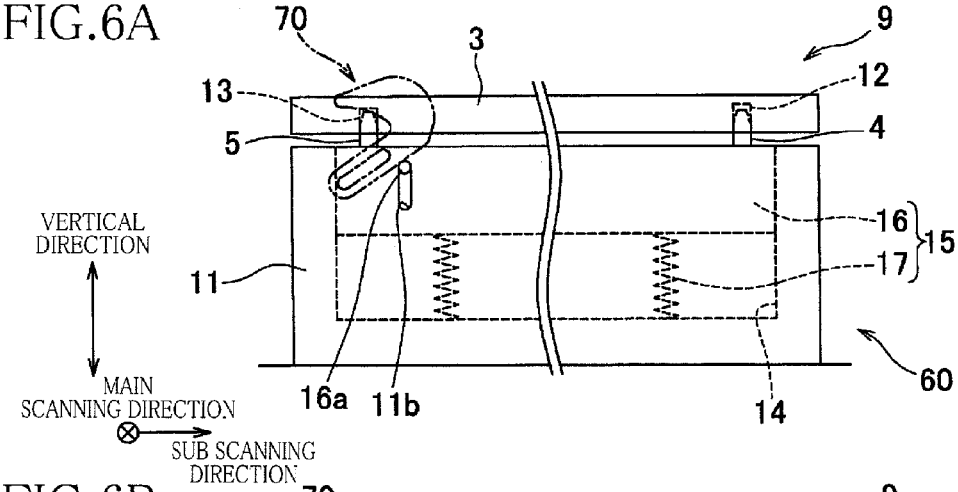
FIGS. 6A-6C are explanatory views showing operating states of the locking mechanism and an interlocking mechanism.
Figure 6B:
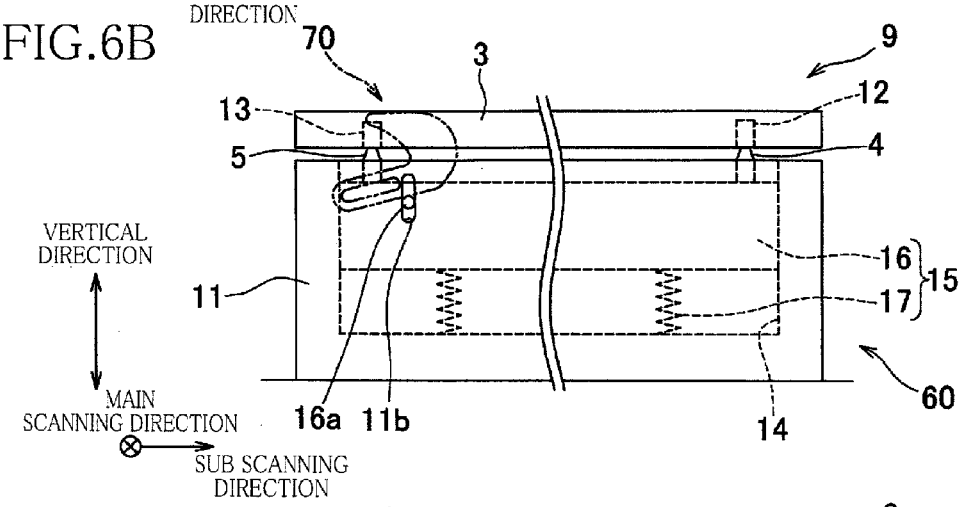

The frame 3 supports the two heads 10 and an upper roller of the feed roller pair 24. The frame 3 also supports the enclosure members 40 such that the enclosure members 40 are elevated and lowered. On the lower surface of the frame 3, the two guide holes 12, 13 with which the respective guide pins 4, 5 are to engage are formed. The guide pins 4, 5 are inserted into the respective guide holes 12, 13 when the upper casing 1*a* is located at the close position and the heads 10 (the recording portion 9) are located at the recording position (the first or the second recording position). The guide pins 4, 5 are inserted into the respective guide holes 12, 13, whereby the guide pins 4, 5 and the guide holes 12, 13 come into engagement with each other. The guide pins 4, 5 and the guide holes 12, 13 constitute a positioning mechanism configured to position the recording portion 9 and the support portion 60 relative to each other in the horizontal direction. That is, the guide pins 4, 5 have a length for enabling the guide pins 4, 5 to be engaged with or insertable into the respective guide holes 12, 13 when the upper casing 1*a* is located at the close position, the heads 10 are located at the recording position, and the locking mechanism 70 is in a restricted state that will be explained. Further, the length of the guide pins 4, 5 is determined such that the guide pins 4, 5 are disengaged from the respective guide holes 12, 13 when the locking mechanism 70 is in a state midway between the restricted state and a non-restricted state, as shown in FIG. 6B, with the upper casing 1*a* and the heads 10 located at the close position and the retracted position, respectively.

The two guide holes 12, 13 are formed so as to be arranged in the sub scanning direction. The guide holes 12, 13 are configured to be opposed to the respective guide pins 4, 5 in the vertical direction when the upper casing 1*a* is located at the close position and the heads 10 are located at the recording position. The guide hole 12 has a circular shape in plan view and has an inside diameter which is substantially the same or slightly larger than an outside diameter of the guide pin 4. Further, a conical tapered portion is formed in the vicinity of the opening of the guide hole 12, thereby facilitating insertion of the guide pin 4 into the guide hole 12.

Like the guide hole 12, the guide hole 13 has a circular shape in plan view and has an inside diameter which is substantially the same or slightly larger than an outside diameter of the guide pin 5. Further, a conical tapered portion is formed in the vicinity of the opening of the guide hole 13, thereby facilitating insertion of the guide pin 5 into the guide hole 13.

Thus, the engagement of the guide holes 12, 13 and the guide pins 4, 5 permits positioning of the frame 3 and the frame 11 relative to each other in the main scanning direction and in the sub scanning direction. That is, the frame 3 and the frame 11 slightly move relative to each other in the horizontal direction when the guide holes 12, 13 and the guide holes 4, 5 come into engagement with each other, whereby the frame 3 and the frame 11 are positioned relative to each other in the main scanning direction and in the sub scanning direction, namely, the relative position of the frame 3 and the frame 11 in the main scanning direction and in the sub scanning direction is fixed. Further, two pairs of the guide pin (4; 5) and the guide hole (12; 13) are provided, whereby the positioning with respect to the relative rotational position of the frame 3 and the frame 11 along the horizontal plane is conducted.

Next, the locking mechanism 70 will be explained with reference to FIGS. 1, 5, and 6.

Figure 5A:
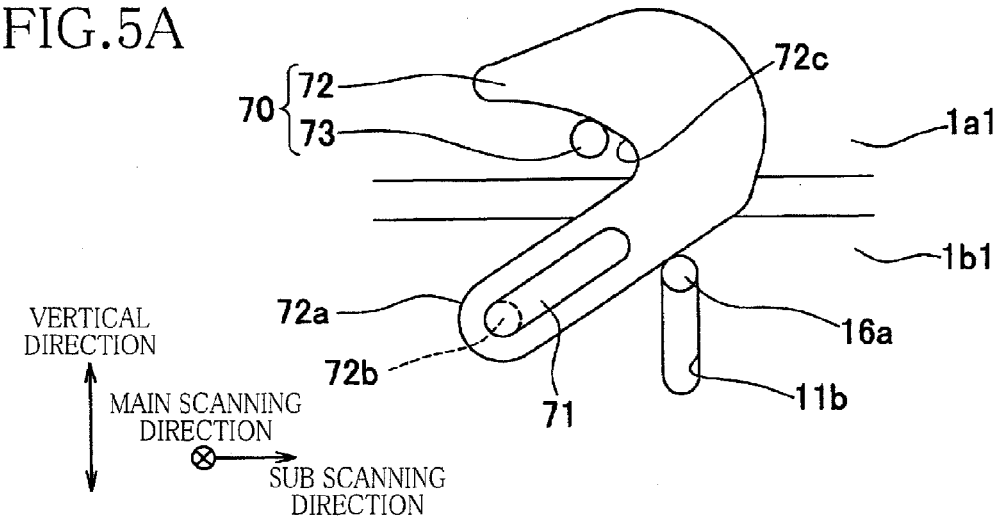
FIGS. 5A-5C are explanatory views showing operating states of a locking mechanism.
Figure 5B:
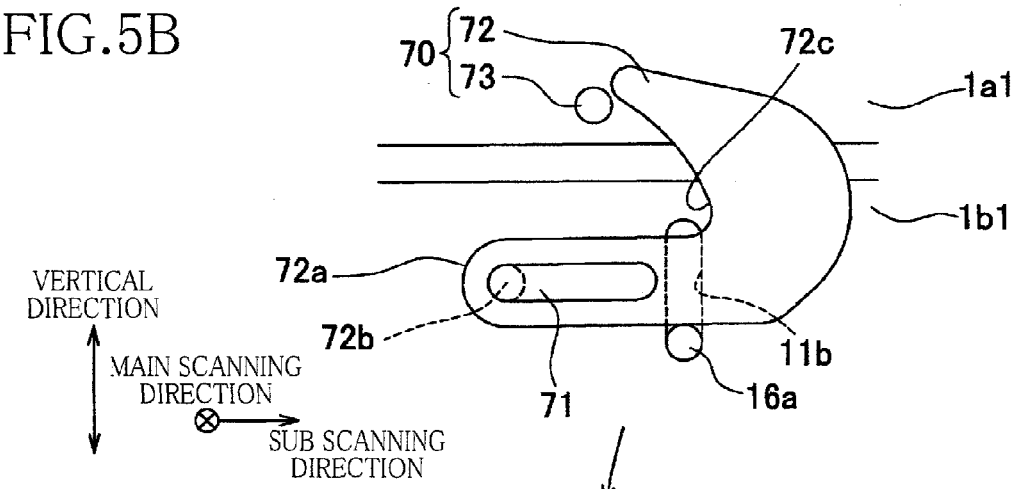

As shown in FIG. 5, the locking mechanism 70 includes a hook 72 and an engaging pin (as an engaging member) 73. As shown in FIG. 5, a distal end of the hook 72 is bent, whereby the hook 72 has an L-letter shape as viewed from an orthogonal direction orthogonal to the vertical direction (i.e. the prescribed direction) in which the guide pins 4, 5 extend. A proximal end portion 72*a* of the hook 72 is connected to the frame 1*b*1 via a shaft 72*b* that extends in the main scanning direction, whereby the hook 72 is supported so as to be pivotable about the shaft 72*b* with respect to the lower casing 1*b*. On one side surface of the hook 72, the lever 71 is formed so as to protrude therefrom. The lever 71 protrudes from the opening 1*b*3 of the cover 1*b*2. When the lever 71 is pivoted by the user in a direction indicated by the arrow in FIG. 1, the hook 72 is pivoted from a restricted position (i.e., a position shown in FIG. 5A) to a non-restricted position (i.e., a position shown in FIG. 5B). Further, the hook 72 is disposed in a space between the frame 1*b*1 and the cover 1*b*2. The engaging pin 73 protrudes from the frame 1*a*1 of the upper casing 1*a* and is disposed in a space between the frame 1*a*1 and the cover 1*a*2. As shown in FIG. 5A, the engaging pin 73 is located at a position at which the engaging pin 73 is in abutting contact with a concave portion 72*c* of the hook 72 (i.e., at a position at which the hook 72 rests on or engages with the engaging pin 73) when the hook 72 is located at the restricted position. The concave portion 72*c* defines an inner surface of a bent portion of the L-letter shape of the hook 72.

Figure 5C:
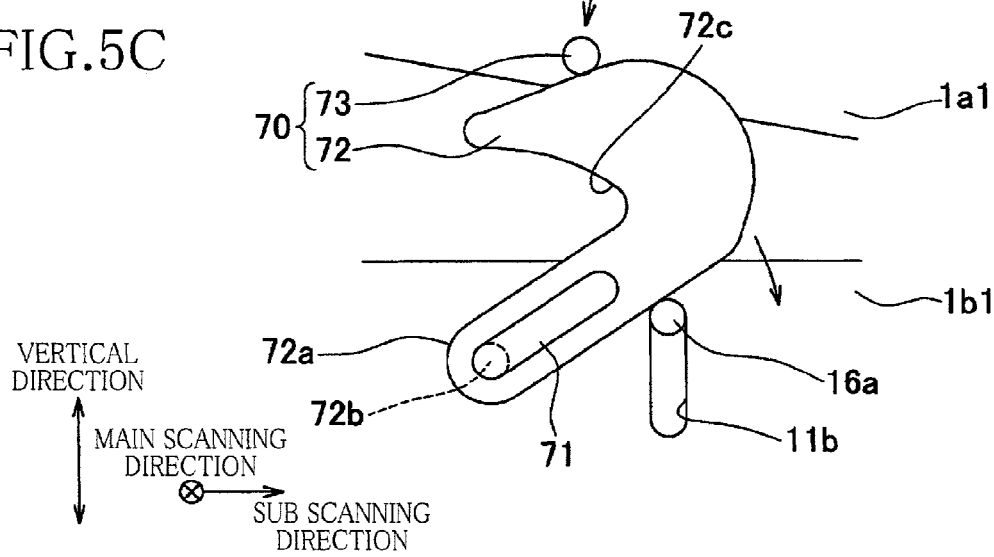

The non-restricted state of the locking mechanism 70 is a state in which the upper casing 1*a* is located at the close position and the hook 72 is located at the non-restricted position at which the hook 72 does not rest on or does not engage with the engaging pin 73, namely, at a position at which the upper casing 1*a* can be pivoted from the close position to the separate position. When the hook 72 is located at the non-restricted position, the engaging pin 73 is not in contact with the concave portion 72*c* of the hook 72, as shown in FIG. 5B. When the engaging pin 73 is not in contact with the concave portion 72*c* of the hook 72, the engaging pin 73 is movable upward in the vertical direction since the hook 72 is not present above the engaging pin 73 in the vertical direction. Accordingly, the upper casing 1*a* that holds the engaging pin 73 can be moved from the close position to the separate position. On the other hand, the restricted state of the locking mechanism 70 is a state in which the upper casing 1*a* is located at the close position and the hook 72 is located at the restricted position at which the hook 72 rests on or engages with the engaging pin 73, namely, at a position at which the upper casing 1*a* that is located at the close position is inhibited from moving. When the hook 72 is located at the restricted position, the engaging pin 73 is in contact with the concave portion 72*c* of the hook 72, as shown in FIG. 5A. When the engaging pin 73 is in contact with the concave portion 72*c* of the hook 72, the engaging pin 73 is immovable upward in the vertical direction since the hook 72 is present above the engaging pin 73 in the vertical direction. Accordingly, the upper casing 1*a* that holds the engaging pin 73 cannot be moved from the close position to the separate position. In FIG. 5C, though the hook 72 is located at the restricted position, the upper casing 1*a* is pivotable since the upper casing 1*a* is not located at the close position and the engaging pin 73 is not in contact with the concave portion 72*c* of the hook 72.

The lower side surface of the hook 72 is kept in engagement or in contact with the protruding portion 16*a*, whereby the hook 72 is configured to be biased by the springs 17 of the interlocking mechanism 15 toward the restricted position. In other words, in conjunction with the hook 72, the protruding portion 16*a* and the movable portion 16 are elevated or lowered. That is, the movable portion 16 moves between the engaged position and the non-engaged position in conjunction with the hook 72, so that the guide pins 4, 5 and the guide holes 12, 13 are selectively placed in one of an engaged state in which the guide pins 4, 5 and the guide holes 12, 13 engage each other and a non-engaged state in which the guide pins 4, 5 and the guide holes 12, 13 do not engage each other.

Figure 6C:
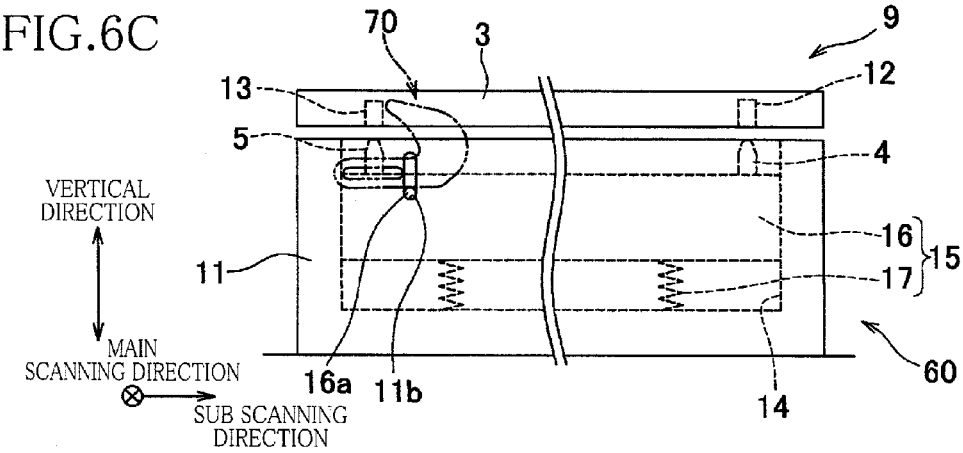

In the structure described above, in a state in which the upper casing 1*a* is located at the close position and the heads 10 are located at the recording position, when the user turns the lever 71*a* so as to pivot the hook 72 from the restricted position shown in FIG. 5A to the non-restricted position shown in FIG. 5B, the hook 72 and the engaging pin 73 are disengaged from each other, namely, the restriction of the pivotal movement of the upper casing 1*a* is canceled or released, and the upper casing 1*a* can be pivoted from the close position to the separate position. The interlocking mechanism 15 operates in association with the motion of the locking mechanism 70 on this occasion, in an interlocking manner. That is, as shown in FIG. 6A, in a state in which the hook 72 is located at the restricted position, the movable portion 16 is located at the engaged position. When the hook 72 pivots toward the non-restricted position, the protruding portion 16*a* (the movable portion 16) moves downward in conjunction with the hook 72. That is, the movable portion 16 is pushed by the pivotal movement of the hook 72, whereby the movable portion 16 moves downward against biasing forces of the springs 17. When the hook 72 pivots to the position shown in FIG. 6B (i.e., a position slightly before the hook 72 reaches the non-restricted position), the guide pins 4, 5 come out of the respective guide holes 12, 13, namely, the movable portion 16 moves to the non-engaged position. Subsequently when the hook 72 reaches the non-restricted position, as shown in FIG. 6C, the movable portion 16 stops moving downward. Also in this instance, the movable portion 16 is located at the non-engaged position.

As described above, when the restriction of the pivotal movement of the upper casing 1*a* by the locking mechanism 70 is canceled or released, the movable portion 16 is located at the non-engaged position. Accordingly, even if the upper casing 1*a* is pivoted from the close position to the separate position in this state, it is possible to prevent interference between the guide pins 4, 5 and the inner walls of the guide holes 12, 13 because the guide pins 4, 5 and the guide holes 12, 13 have been disengaged from each other. In the present embodiment, when the upper casing 1*a* is pivoted from the close position to the separate position, the guide holes 12, 13 move such that a moving locus of each of the guide holes 12, 13 is an arc, as shown in FIG. 3. In other words, a moving region of the guide hole 12 is a region between two arcs L3*a*, L4*a* indicated by the long dashed double-short dashed line in FIG. 3 while a moving region of the guide hole 13 is a region between two arcs L1*a*, L2*a* indicated by the long dashed double-short dashed line in FIG. 3. If the upper casing 1*a* is pivoted from the close position to the separate position without locating the movable portion 16 at the non-engaged position, the guide pins 4, 5 get out of the moving regions of the respective guide holes 12, 13, so that the guide pins 4, 5 and the inner walls of the guide holes 12, 13 interfere with each other. In the present embodiment, however, the locking mechanism 70 needs to be placed in the non-restricted state for allowing the upper casing 1*a* to be pivoted from the close position to the separate position. When the locking mechanism 70 is placed in the non-restricted state, the movable portion 16 is located at the non-engaged position. Therefore, it is possible to prevent the above-mentioned interference between the guide pins 4, 5 and the inner walls of the guide holes 12, 13.

When the user releases the lever 71 in a state in which the upper casing 1*a* is located at the separate position, the movable portion 16 moves upward and returns to the engaged position owing to the biasing forces of the springs 17. In this instance, the hook 72 is biased to the restricted position by the springs 17 via the protruding portion 16*a*. That is, the hook 72 automatically returns from the non-restricted position to the restricted position. Thereafter, when the user moves the upper casing 1*a* that is located at the separate position so as to pivot to the close position, the engaging pin 73 and the upper side surface of the hook 72 come into contact with each other, as shown in FIG. 5C. In association with the pivotal movement of the upper casing 1*a* to the close position, the engaging pin 73 pushes the hook 72, and the hook 72 is thereby pivoted clockwise in FIG. 5C. On this occasion, the hook 72 is pivoted to such an extent that the engaging pin 73 is located at a position at which the engaging pin 73 gets over or goes beyond the distal end of the hook 72 (i.e., the non-restricted position), and the movable portion 16 is located at the non-engaged position before the hook 72 reaches this position (i.e., the non-restricted position). Therefore, even where the upper casing 1*a* is located at the close position, it is possible to prevent the interference between the guide pins 4, 5 and the inner walls of the guide holes 12, 13. Thereafter, when the engaging pin 73 gets over or goes beyond the distal end of the hook 72 and the upper casing 1*a* approaches the close position, the hook 72 returns to the restricted position. Accordingly, subsequently when the upper casing 1*a* is located at the close position, the hook 72 rests on or engages with the engaging pin 73 and the pivotal movement of the upper casing 1*a* is restricted by the locking mechanism 70.

Figure 7:
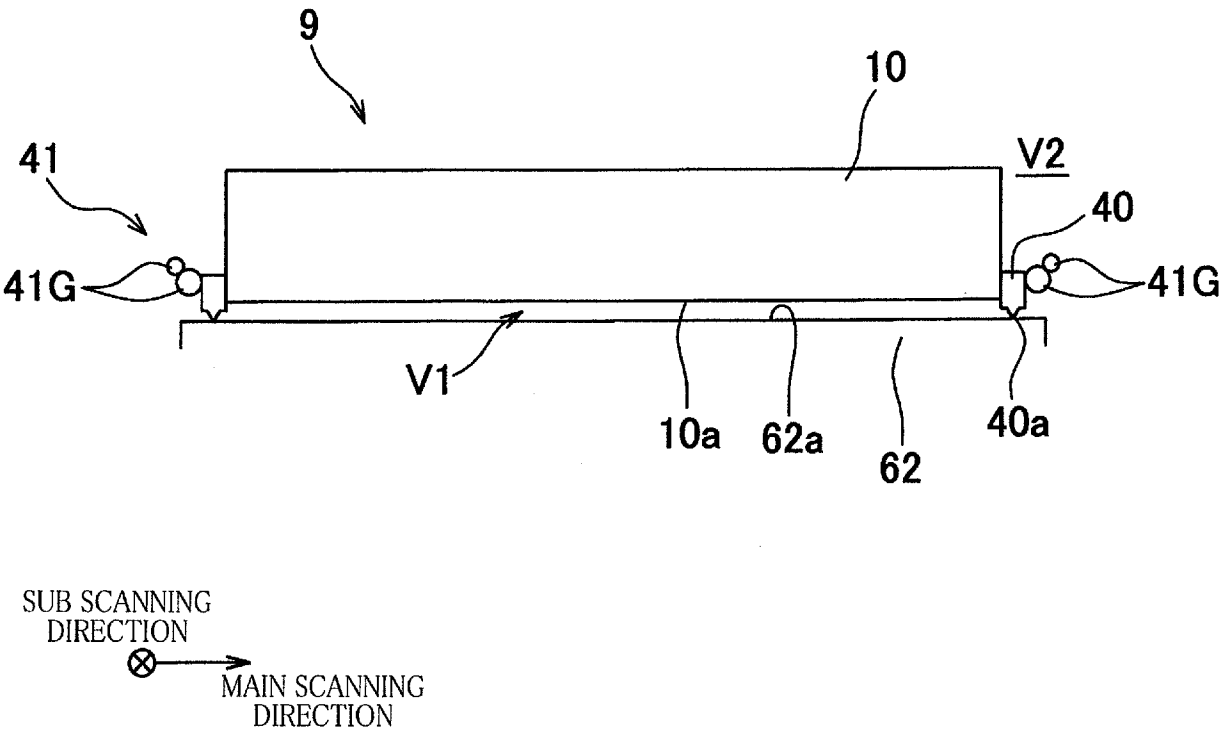
FIG. 7 is a schematic view showing a head and an enclosure member.

Next, the enclosure members 40 will be explained with reference to FIG. 7.

Each enclosure member 40 is formed of an elastic material such as rubber and has a short sleeve-like shape in plan view, so as to enclose or surround the periphery of the ejection surface 10*a* of the corresponding head 10. The enclosure member 40 has, at its lower end, a protruding portion 40*a* having an inverted triangular cross sectional shape.

The enclosure members 40 are configured to be elevated and lowered by a cap elevating and lowering mechanism 41 in the vertical direction. The cap elevating and lowering mechanism 41 includes a plurality of gears 41G and drive motors 41M (FIG. 8) for driving the gears 41G. By driving the gears 41G, the enclosure members 40 are elevated and lowered in the vertical direction (as the prescribed direction). By the movement of the enclosure members 40 upward and downward, the protruding portions 40*a* are selectively positioned at one of an elevated position (FIGS. 2 and 10) at which the protruding portions 40*a* are located at a higher position than the ejection surfaces 10*a*; and a lowered position (FIG. 7) at which the protruding portions 40*a* are located at a lower position than the ejection surfaces 10*a* and contact the corresponding opposable faces 62*a*. The distance over which the enclosure members 40 can move in the vertical direction is determined so as to enable the enclosure members 40 to contact the corresponding opposable faces 62*a* when the heads 10 are positioned at either of the first and the second recording positions. In other words, the recording position of the heads 10 also functions as a capping position at which the ejection surfaces 10*a* of the heads 10 are hermetically sealed as described below by moving the enclosure members 40 to the lowered position. Accordingly, it is not necessary to largely move the recording portion 9 or the support portion 60 for capping, thereby eliminating provision of a space in which the recording portion 9 or the support portion 60 is retracted. Therefore, the printer 1 can be downsized.

The controller 1*p* controls the cap elevating and lowering mechanism 41 (the drive motors 41M) to drive the gears 41G, such that the enclosure members 40 are positioned at the lowered position for capping the corresponding ejection surfaces 10*a* and such that the enclosure members 40 are positioned at the elevated position when the ejection surfaces 10*a* need not be capped. During capping, each ejection surface 10*a* is hermetically sealed by abutting contact of the tip of the protruding portion 40*a* with the opposable face 62*a*, as shown in FIG. 7, namely, an ejection space V1 formed between the ejection surface 10*a* and the opposable face 62*a* is separated from an external space V2, thereby preventing the liquid in the vicinity of the ejection openings of the ejection surface 10*a* from drying. Thus, the enclosure members 40 and the cap elevating and lowering mechanism 41 constitute a capping mechanism.

Referring next to FIG. 8, the electric structure of the printer 1 will be explained.

The controller 1*p* includes a Central Processing Unit (CPU) 101 as an arithmetic processing unit, a Read Only Memory (ROM) 102, a Random Access Memory (RAM) 103 including a nonvolatile RAM, an Application Specific Integrated Circuit (ASIC) 104, an Interface (I/F) 105, an Input/Output Port (I/O) 106, etc. In the ROM 102, programs to be executed by the CPU 101 and various fixed data are stored. In the RAM 103, data necessary when the programs are executed is temporarily stored. In the ASIC 104, rewriting and sorting of image data such as signal processing and image processing are executed. The I/F 105 transmits and receives data to and from an external device such as a personal computer (PC) connected to the printer 1. The I/O 106 carries out an input/output of detection signals of various sensors.

The controller 1*p* is connected to a sheet supply motor 21M, feed motors 22M-28M, the sheet sensor 32, the head elevating and lowering mechanism 33, the wiper moving mechanisms 68, control circuit boards of the heads 10, etc. The controller 1*p* is connected further to the pumps 34, rotation motors 63M, and the drive motors 41M. While the pump 34, the rotation motor 63M, and the drive motor 41M are provided for each of the two heads 10, only one pump 34, one rotation motor 63M, and one drive motor 41M of one head 10 are shown in FIG. 8 in the interest of brevity.

The control executed by the controller 1*p* will be next explained with reference to FIGS. 9 and 10.

Figure 9:
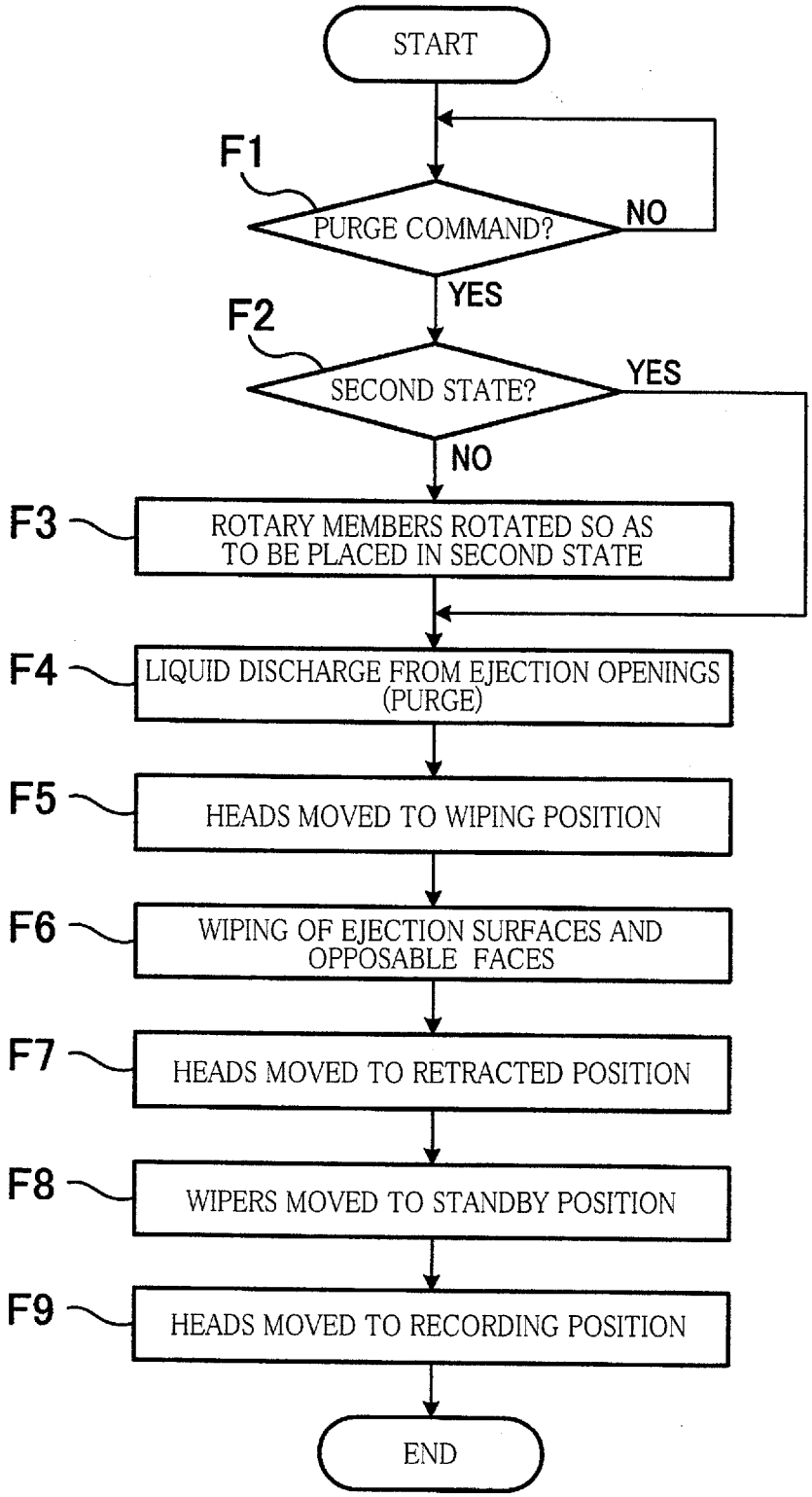
FIG. 9 is a flow chart showing a control executed by a controller of the printer.

As shown in FIG. 9, the controller 1*p* initially judges whether a purge command is received or not (Step 1: F1). The purge command is received when paper jamming occurs in the sheet conveyance path, or after non-ejection has continued for more than a predetermine time, for instance.

When the controller 1*p* receives the purge command (F1: YES), the controller 1*p* judges whether the rotary members 63 are in the second state or not (Step 2: F2). Where it is judged in Step 2 that the rotary members 63 are in the first state, Step 3 (F3) is implemented. Where it is judged in Step 2 that the rotary members 63 are in the second state, Step 4 (F4) is implemented. In Step 3, the controller 1*p* drives the rotation motors 63M so as to rotate the rotary members 63, whereby the rotary members 63 are placed in the second state.

Figure 10A:
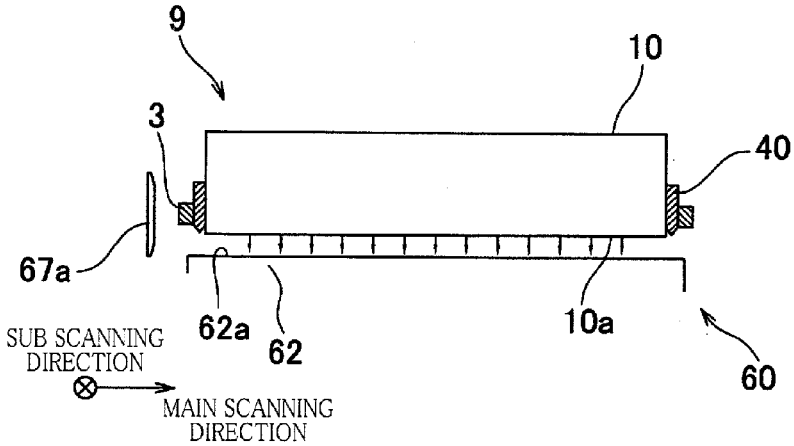
FIGS. 10A-10C are views for explaining a purging operation and a wiping operation.
Figure 10B:
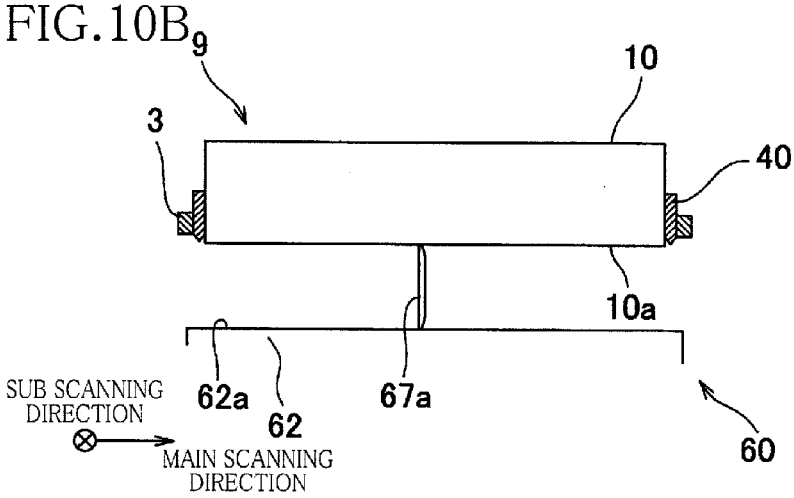

In Step 4, the controller 1*p* drives the pumps 34 such that a predetermined amount of the liquids are discharged onto the respective opposable faces 62*a* from all of the ejection openings as shown in FIG. 10A, namely, the purging operation is carried out. Subsequently, the controller 1*p* controls the head elevating and lowering mechanism 33 to move the heads 10 from the recording position to the wiping position as shown in FIG. 10B (Step 5: F5). At the wiping position (the second position) which is between the retracted position and the second recording position, the guide pins 4, 5 are not in engagement with the respective guide holes 12, 13 and the upper ends of the respective wipers 67*a* contact the corresponding ejection surfaces 10*a* by the movement of the wipers 67*a* in the main scanning direction. Further, at the wiping position, the lower ends of the respective wipers 67*a* contact the corresponding opposable faces 62*a* by the movement of the wipers 67*a* in the main scanning direction. It is noted that, when the heads 10 are positioned at the retracted position, the wipers 67*a* do not come into contact with the corresponding ejection surfaces 10*a* even where the wipers 67*a* move in the main scanning direction so as to pass respective positions at which the wipers 67*a* are opposed to the corresponding ejection surfaces 10*a*.

After Step 5, the controller 1*p* controls the wiper moving mechanisms 68 to move the respective wipers 67*a* from the standby position in the main scanning direction, so that the ejection surfaces 10*a* and the opposable faces 62*a* are wiped, namely, the wiping operation is carried out (Step 6: F6). Thus, the liquid adhering to the ejection surface 10*a* and the opposable face 62*a* of each head 10 is removed therefrom.

Figure 10C:
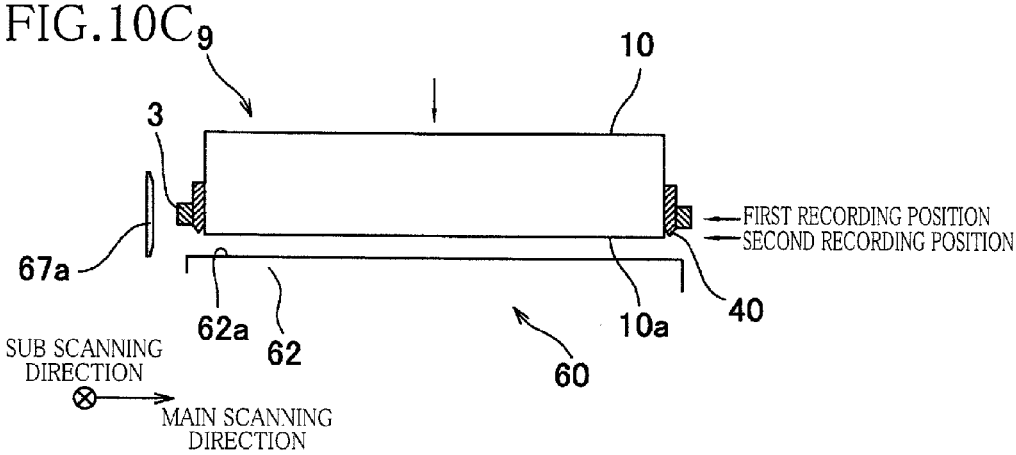

After Step 6, the controller 1*p* controls the head elevating and lowering mechanism 33 to move the heads 10 from the wiping position to the retracted position (Step 7: F7). Subsequently, the controller 1*p* controls the wiper moving mechanisms 68 to return the respective wipers 67*a* to the standby position (Step 8: F8). In this instance, the wipers 67*a* again wipe only the corresponding opposable faces 62*a*. After Step 8, the controller 1*p* controls the head elevating and lowering mechanism 33 to move the heads 10 from the retracted position to the recording position as shown in FIG. 10C (Step 9: F9). On this occasion, the heads 10 are normally moved to the first recording position. However, where the record command in which setting of the sheet P to be used is thick paper setting is received before the heads 10 are moved to the first recording position, the heads 10 are disposed at the second recording position. It is noted that the above-described purging operation and wiping operation may be carried out for only one of the two heads 10.

Thereafter, the controller 1*p* judges whether or not the record command is received before a predetermined time elapses. Where the record command is not received before the predetermined time elapses, the capping operation is carried out. That is, the controller 1*p* drives the drive motors 41M to move the respective enclosure members 40 from the elevated position to the lowered position, thereby establishing a capping state in which the ejection space V1 is separated from the external space V2, namely, in which drying of the liquid in the vicinity of the ejection openings of each ejection surface 10*a* is restrained. The controller 1*p* then maintains the capping state until next record command or purge command is received.

As explained above, since the heads 10 are located at the capping position in the capping state, the guide pins 4, 5 are in engagement with the respective guide holes 12, 13. In this instance, even if the upper casing 1*a* is moved by the user from the close position to the separate position, the interlocking mechanism 15 operates in conjunction with the locking mechanism 70 so that the movable portion 16 is moved to the non-engaged position. Accordingly, it is possible to prevent interference between the inner walls of the guide holes 12, 13 and the guide pins 4, 5 while ensuring positioning of the recording portion 9 and the support portion 60 relative to each other in the main scanning direction and in the sub scanning direction.

On the other hand, where the record command is received before the predetermined time elapses, the controller 1*p* judges whether the rotary members 63 are in the first state or not. Where the rotary members 63 are in the second state, the controller 1*p* drives the rotation motors 63M so as to rotate the rotary members 63, whereby the rotary members 63 are placed in the first state. Where the rotary members 63 are in the first state, on the other hand, the first state is maintained. Thereafter, the controller 1*p* permits execution of the image recording operation on the basis of the received record command.

In the image recording operation, the controller 1*p* controls the head elevating and lowering mechanism 33 to dispose the heads 10 at one of the first and the second recording positions and drives the sheet supply motor 21M (FIG. 8) for the sheet supply roller 21 and the feed motors 22M-28M (FIG. 8) for the respective feed roller pairs 22-28, on the basis of the record command received from the external device. The sheet P supplied from the sheet tray 20 is fed to the support portion 60 through the guides 29. The sheet P fed to the support portion 60 is conveyed while being supported on the support surfaces 61*a* and held or nipped by the rollers of the respective feed roller pairs 23, 24, 25 that are being rotated. When the sheet P passes right below the two heads 10 successively, the heads 10 are driven under the control of the controller 1*p* and the liquid is ejected to the surface of the sheet P from the ejection openings of each ejection surface 10*a*, so that an image is formed on the sheet P. The liquid ejecting operation from the ejection openings of each ejection surface 10*a* is carried out under the control of the controller 1*p* on the basis of the detection signal of the sheet sensor 32. The sheet P is subsequently conveyed upward while being guided by the guides 29 and held or nipped by the rollers of the respective feed roller pairs 26, 27, 28, and finally discharged to the discharge portion 31 through an opening 30 formed in the upper portion of the upper casing 1*a*.

When the sheet P is being conveyed on the basis of the record command or when the sheet P is jammed in the midst of conveyance of the sheet P on the basis of the record command, the guide pins 4, 5 and the guide holes 12, 13 are in engagement with each other since the heads 10 are located at the recording position. In those instances, even where the upper casing 1*a* is moved by the user from the close position to the separate position, for instance, the interlocking mechanism 15 operates in conjunction with the locking mechanism 70 so that the movable member 16 is moved to the non-engaged position. Therefore, it is possible to prevent interference between the inner walls of the guide holes 12, 13 and the guide pins 4, 5 while ensuring positioning of the recording portion 9 and the support portion 60 relative to each other in the main scanning direction and in the sub scanning direction.

As explained above, in the printer 1 according to the present embodiment, the guide pins 4, 5 and the guide holes 12, 13 are in the non-engaged state when the locking mechanism 70 is in the non-restricted state, whereby the interference between the guide pins 4, 5 and the inner walls of the guide holes 12, 13 can be prevented even if the upper casing 1*a* is pivoted. Further, it is possible to ensure a high degree of positioning accuracy by the engagement of the guide holes 12, 13 and the guide pins 4, 5.

Since the positioning mechanism is constituted by the guide pins 4, 5 and the guide holes 12, 13, the recording portion 9 and the support portion 60 can be positioned relative to each other in the main scanning direction and in the sub scanning direction, and the positioning with respect to the relative rotational position of the recording portion 9 and the support portion 60 along the horizontal plane can be conducted. If the guide pins 4, 5 and the guide holes 12, 13 are configured not to interfere with each other when the upper casing 1*a* is pivoted from the close position to the separate position, by forming each guide hole 12, 13 into an elongate shape that is long in the sub scanning direction, without providing the interlocking mechanism 15 operable in conjunction with the locking mechanism 70, the recording portion 9 and the support portion 60 cannot be positioned relative to each other in the sub scanning direction. If the relative position of the recording portion 9 and the support portion 60 in the sub scanning direction cannot be fixed, the recording portion 9 and the support portion 60 may be shifted relative to each other in the sub scanning direction, and the heads 10 and the opposable faces 62*a* may be shifted relative to each other. In those instances, there may be a risk that the position of the sheet P at which the image is formed may be shifted from an intended position and a risk that the ejection surfaces 10*a* cannot be capped by the enclosure members 40. For enabling the ejection surfaces 10*a* to be capped even where the recording portion 9 and the support portion 60 are shifted relative to each other in the sub scanning direction, it is needed to enlarge the size of the opposable faces 62*a*, undesirably resulting in an increase in the size of the printer 1 per se. In the present invention, however, when the upper casing 1*a* is pivoted from the close position to the separate position, the guide pins 4, 5 and the guide holes 12, 13 are placed in the non-engaged state by the interlocking mechanism 15 operable in conjunction with the locking mechanism 70, thereby avoiding the problems described above.

In the present embodiment, the locking mechanism 70 configured to inhibit or allow the pivotal movement of the upper casing 1*a* is constituted by the hook 72 and the engaging pin 73, simplifying the structure of the locking mechanism 70. Further, the interlocking mechanism 15 is constituted by the movable portion 16 and the springs 17, and the springs 17 bias the hook 72 toward the restricted position via the movable portion 16, whereby it is not needed to additionally provide a biasing mechanism for biasing the locking mechanism 70 and the hook 72 to the restricted position, resulting in a simplified structure.

Since the present printer 1 is equipped with the head elevating and lowering mechanism 33, the recording portion 9 and the support portion 60 can be relatively moved toward and away from each other between the recording position and the retracted position (the wiping position) without a need of pivoting the upper casing 1*a*. Further, the recording portion 9 can be moved to the first recording position and the second recording position by the head elevating and lowering mechanism 33, the position of the heads 10 can be changed depending upon the thickness of the sheet P. Moreover, the present printer 1 is equipped with the capping mechanism constructed as described above, the ejection surfaces 10*a* can be capped at the recording position. The capping mechanism constructed as described above eliminates a need of largely moving the recording portion 9 or the support portion 60 for capping, thereby eliminating provision of a space in which the recording portion 9 or the support portion 60 is retracted. Accordingly, the printer 1 can be downsized. In addition, the user can freely pivots the upper casing 1*a* to the separate position even when the ejection surfaces 10*a* are in the capping state.

In the present embodiment, the guide pins 4, 5 are formed on the side of the support portion 60 that is not elevated and lowered by the head elevating and lowering mechanism 33 as the moving mechanism, and the guide pins 4, 5 are moved by the interlocking mechanism 15. Where the moving mechanism elevates and lowers the support portion 60 (including the guide pins), the interlocking mechanism needs to additionally move the moving mechanism, undesirably complicating the structure. In the present invention, however, the interlocking mechanism 15 moves the guide pins 4, 5 formed on the side of the support portion 60 that is not elevated and lowered by the head elevating and lowering mechanism 33, so that the structure of the interlocking mechanism 15 is simplified. Moreover, because the interlocking mechanism 15 does not need to additionally move the head elevating and lowering mechanism 33, it is possible to reduce a load when the locking mechanism 70 is operated via the interlocking mechanism 15.

While the embodiment of the invention has been described, it is to be understood that the present invention may be embodied with various other changes and modifications, which may occur to those skilled in the art, without departing from the scope of the invention defined in the attached claims.

For instance, only one pair of the guide pin and the guide hole may be provided as the positioning mechanism. Two pairs of the guide pin (4; 5) and the guide hole (12; 13) may be disposed so as to be arranged in a direction that intersects the sub scanning direction and the main scanning direction or may be disposed at respective positions at which respective distances from the shaft 1*h* are mutually the same, such that the two pairs are arranged in the main scanning direction. Three or more pairs of the guide pin and the guide hole may be provided. The guide pin may have a length that enables engagement thereof with the guide hole when the upper casing 1*a* is located at the close position even where the heads are located at the wiping position. The guide holes 12, 13 may be provided in the support portion 60 while the guide pins 4, 5 may be provided in the recording portion 9. The guide holes 12, 13 may be formed so as to penetrate the frame 11. The recording portion may be constituted only by the heads 10. In this instance, the guide pin or the guide hole may be formed directly in the heads 10.

The interlocking mechanism may be configured to move the guide holes 12, 13 in the extension direction of the guide pins 4, 5, in place of the guide pins 4, 5. In this instance, the guide holes 12, 13 may be formed at the movable portion 16 while the guide pins 4, 5 may be formed at the frame 3. The interlocking mechanism may be configured to move the guide pin or the guide hole provided on the side of the recording portion 9. In this instance, the moving mechanism (in the form of the head elevating and lowering mechanism 33 in the illustrated embodiment) is preferably configured to elevate and lower the support portion 60. The interlocking mechanism may be configured to move the guide pin or the guide hole provided on the side of the recording portion 9 or the support portion 60 that is elevated and lowered by the moving mechanism, together with the moving mechanism. Further, the interlocking mechanism 15 may be configured not to bias the hook 72 toward the restricted position via the movable portion 16. In this instance, the locking mechanism 70 may be configured to have a biasing mechanism for biasing the hook 72 toward the restricted position.

The moving mechanism may not be provided. Unlike the head elevating and lowering mechanism 33 in the illustrated embodiment, the moving mechanism may be configured to elevate and lower the support portion 60 or may be configured to elevate and lower both of the recording portion 9 and the support portion 60. The recording position may include only the first recording position. The capping mechanism may be configured to hermetically seal the ejection surfaces 10*a* by bringing the enclosure members 40 into abutting contact with the support surfaces 61*a*. The capping mechanism may be eliminated.

The present invention is applicable to both of a serial type and a line type, and is applicable to a facsimile machine and a copying machine other than the printer. The present invention is applicable to recording apparatus configured to carry out recording by ejecting a liquid other than the ink. The present invention is applicable to recording apparatus other than the ink-jet type, such as a laser type and a thermal type. The recording medium is not limited to the sheet P, but may be various recordable media.

What is claimed is:

1. A recording apparatus, comprising:

a support portion configured to support a recording medium;

a recording portion configured to record an image on the recording medium supported by the support portion;

a first casing configured to hold the support portion;

a second casing connected to the first casing through a shaft and pivotable relative to the first casing about the shaft, the second casing being configured to be selectively positioned by a pivotal movement thereof at one of:

a close position at which the second casing is positioned close to the first casing; and a separate position at which the second casing is positioned more distant from the first casing than when the second casing is positioned at the close position, the second casing being configured to hold the recording portion such that the support portion and the recording portion are opposed to each other when the second casing is positioned at the close position, and a distance between the recording portion and the support portion when the second casing is positioned at the separate position being larger than a distance between the recording portion and the support portion when the second casing is positioned at the close position;

a positioning mechanism comprising a guide pin that is formed at one of the recording portion and the support portion and that extends in a prescribed direction different from a direction in which the shaft extends and a guide hole that is formed at the other of the recording portion and the support portion, the guide pin and the guide hole configured to move relative to each other in association with the pivotal movement of the second casing, the positioning mechanism being configured to define a relative position of the recording portion and the support portion by engagement of the guide pin and the guide hole when the second casing is positioned at the close position, the positioning mechanism being configured such that the guide pin and the guide hole do not engage each other when the second casing is positioned at the separate position;

a restricting mechanism configured such that, when the second casing is positioned at the close position, the restricting mechanism is selectively placed in one of: a restricted state in which the pivotal movement of the second housing is restricted; and a non-restricted state in which the pivotal movement of the second housing is not restricted; and an interlocking mechanism configured to move one of the guide pin and the guide hole in the prescribed direction in conjunction with the restricting mechanism, such that the guide pin and the guide hole are selectively placed in one of:

an engaged state in which the guide pin and the guide hole engage each other, when the restricting mechanism is in the restricted state; and a non-engaged state in which the guide pin and the guide hole do not engage each other, when the restricting mechanism is in the non-restricted state.

2. The recording apparatus according to claim 1, wherein the restricting mechanism comprises:

a hook pivotably supported by one of the first housing and the second housing; and an engaging member supported by the other of the first housing and the second housing, the hook being configured to rest on the engaging member, wherein, when the restricting mechanism is in the restricted state, the hook is positioned at a restricted position at which the hook rests on the engaging member, and wherein, when the restricting mechanism is in the non-restricted state, the hook is positioned at a non-restricted position at which the hook does not rest on the engaging member.

3. The recording apparatus according to claim 2, wherein the interlocking mechanism comprises:

a movable portion which is in engagement with the hook and which is configured to move in association with a pivotal movement of the hook, together with the one of the guide pin and the guide hole; and a biasing portion configured to bias the movable portion toward an engaged position at which the guide pin and the guide hole are placed in the engaged state, and wherein the biasing portion is configured to bias the hook toward the restricted position via the movable portion.

4. The recording apparatus according to claim 3, wherein the movable portion is configured to move in the prescribed direction.

5. The recording apparatus according to claim 4, wherein the hook has an L-letter shape as viewed from an orthogonal direction orthogonal to the prescribed direction.

6. The recording apparatus according to claim 4, wherein the engaging member is in contact with a concave portion of the hook when the hook is located at the restricted position, and the engaging member is not in contact with the concave portion of the hook when the hook is located at the non-restricted position.

7. The recording apparatus according to claim 6, wherein the movable portion is kept in contact with an outer wall of the hook, and wherein the movable portion is configured to move against a biasing force of the biasing portion by being pushed due to the pivotal movement of the hook.

8. The recording apparatus according to claim 1, further comprising a moving mechanism configured to move at least one of the recording portion and the support portion in the prescribed direction, such that the recording portion and the support portion are selectively positioned at one of a first position and a second position, a distance between the recording portion and the support portion at the second position being larger than a distance therebetween at the first position, when the second casing is positioned at the close position.

9. The recording apparatus according to claim 8, wherein the moving mechanism is configured to move one of the recording portion and the support portion, and wherein the other of the guide pin and the guide hole is formed at the one of the recording portion and the support portion.

10. The recording apparatus according to claim 8, wherein the first position is a recording position at which an image is recorded on the recording medium by the recording portion.

11. The recording apparatus according to claim 10, wherein the guide pin and the guide hole engage each other when the recording portion and the support portion are positioned at the first position, and the guide pin and the guide hole do not engage each other when the recording portion and the support portion are positioned at the second position.

12. The recording apparatus according to claim 8, further comprising: an opposable portion configured to be opposed to the recording portion; and a capping mechanism comprising an enclosure member disposed around the recording portion so as to enclose a recording surface of the recording portion that is to be opposed to the opposable portion, the capping mechanism being configured to hermetically seal the recording surface by abutting contact of the enclosure member with the opposable portion, wherein the first position is a capping position at which the recording surface is hermetically sealed.

13. The recording apparatus according to claim 8, wherein the moving mechanism is configured to move the at least one of the recording portion and the support portion such that the recording portion and the support portion are positioned further at a third position between the first position and the second position.

14. The recording apparatus according to claim 1, wherein the prescribed direction is a vertical direction.

15. The recording apparatus according to claim 1, wherein the recording portion includes an ink-jet head, the recording portion being configured to record the image on the recording medium by ejecting ink from the ink-jet head.

16. A recording apparatus, comprising:

a support portion configured to support a recording medium;

a recording portion configured to record an image on the recording medium supported by the support portion;

a first casing configured to hold the support portion;

a second casing connected to the first casing through a shaft and pivotable relative to the first casing about the shaft, the second casing being configured to be selectively positioned by a pivotal movement thereof at one of:

a close position at which the second casing is positioned close to the first casing; and a separate position at which the second casing is positioned more distant from the first casing than when the second casing is positioned at the close position, and the second casing being configured to hold the recording portion such that the support portion and the recording portion are opposed to each other when the second casing is positioned at the close position;

a positioning mechanism comprising a guide pin that extends in a prescribed direction and a guide hole which move relative to each other in association with the pivotal movement of the second casing, the positioning mechanism being configured to define a relative position of the recording portion and the support portion by engagement of the guide pin and the guide hole when the second casing is positioned at the close position;

a restricting mechanism configured such that, when the second casing is positioned at the close position, the restricting mechanism is selectively placed in one of: a restricted state in which the pivotal movement of the second housing is restricted; and a non-restricted state in which the pivotal movement of the second housing is not restricted;

an interlocking mechanism configured to move one of the guide pin and the guide hole in the prescribed direction in conjunction with the restricting mechanism, such that the guide pin and the guide hole are selectively placed in one of:

an engaged state in which the guide pin and the guide hole engage each other, when the restricting mechanism is in the restricted state; and a non-engaged state in which the guide pin and the guide hole do not engage each other, when the restricting mechanism is in the non-restricted state; and a moving mechanism configured to move at least one of the recording portion and the support portion in the prescribed direction, such that the recording portion and the support portion are selectively positioned at one of a first position and a second position, a distance between the recording portion and the support portion at the second position being larger than a distance therebetween at the first position, when the second casing is positioned at the close position.

17. The recording apparatus according to claim 16, wherein the moving mechanism is configured to move one of the recording portion and the support portion, and wherein the other of the guide pin and the guide hole is formed at the one of the recording portion and the support portion.

18. The recording apparatus according to claim 16, wherein the first position is a recording position at which an image is recorded on the recording medium by the recording portion.

19. The recording apparatus according to claim 18, wherein the guide pin and the guide hole engage each other when the recording portion and the support portion are positioned at the first position, and the guide pin and the guide hole do not engage each other when the recording portion and the support portion are positioned at the second position.

20. The recording apparatus according to claim 16, wherein the moving mechanism is configured to move the at least one of the recording portion and the support portion such that the recording portion and the support portion are positioned further at a third position between the first position and the second position.

* * * * *